US005703560A

United States Patent [19]

Short et al.

[11] Patent Number: 5,703,560

[45] Date of Patent: Dec. 30, 1997

[54] THERMOSTAT WITH ONE-PIECE RESET MECHANISM AND CONTACT ASSEMBLY

[75] Inventors: Stephen P. Short, Johnston, R.I.; Philip R. Lichtman, Newton, Mass.

[73] Assignee: Elmwood Sensors, Inc., Pawtucket, R.I.

[21] Appl. No.: 526,786

[22] Filed: Sep. 11, 1995

[51] Int. Cl.[6] ..... H01H 37/70; H01H 37/04

[52] U.S. Cl. ..... 337/348; 337/333; 337/356; 337/380

[58] Field of Search ..... 337/333, 334, 337/343, 348, 365, 356, 380

[56] References Cited

U.S. PATENT DOCUMENTS

| | | | |
|---|---|---|---|
| 3,081,388 | 3/1963 | Cox | 337/348 |
| 3,525,968 | 8/1970 | Hire | 337/348 |
| 4,039,991 | 8/1977 | Bucheister | 337/348 |
| 4,349,806 | 9/1982 | Boulanger | 337/343 |
| 4,368,451 | 1/1983 | Bucheister | 337/380 |
| 4,782,318 | 11/1988 | Boulanger | 337/380 |
| 5,003,282 | 3/1991 | Boulanger | 337/348 |
| 5,157,370 | 10/1992 | Engelbach et al. | 337/348 |

*Primary Examiner*—Michael W. Phillips
*Assistant Examiner*—Jayprakash N. Gandhi
*Attorney, Agent, or Firm*—Salter & Michaelson

[57] ABSTRACT

A thermostatic switch has a housing and a temperature responsive bimetallic disc located in the housing and responsive to a predetermined temperature for exerting a flexing action. A fixed contact member is located in the cavity along with a movable contact member which is biased and movable between a switch-closed position in which it makes electrical contact with the fixed contact member and a switch-open position in which it is spaced from the fixed contact member. An actuating member is located in the housing, and is responsive to flexing movement of the disc for moving the movable contact member from the switch-closed position to the switch-open position. A hook portion is mounted within the cavity of the housing, the hook portion engaging an arm portion of the movable contact member upon the movement of the movable contact member to its switch-open position and entering an opening of the arm portion for retaining and maintaining the movable contact member in its switch open position.

7 Claims, 4 Drawing Sheets

THERMOSTAT WITH ONE-PIECE RESET MECHANISM AND CONTACT ASSEMBLY

BACKGROUND OF THE INVENTION

1. Field of the Invention

This invention relates generally to thermostatic switches and more particularly to a thermostatic switch having a manual reset feature built into the actuating mechanism of the switch.

2. Description of the Prior Art

The thermostatic switch of the present invention is designed to be used in photocopying machines, computers, small electrical appliances and the like. Most switches presently available for such use are capable of being reset, and typically include a manually operable plunger that is engageable with an actuating member which is in turn engageable with a bimetallic disc. Bimetallic discs are well-known in the art of thermostatic switches and are designed to flex or move when the environment in which the switch is placed reaches a predetermined temperature. In prior switches, resetting of the circuit in the switch was accomplished by pressing a reset element in the switch to move the actuating member into engagement with the disc for completing the circuit.

One problem associated with these types of switches is that often it is not desirable to return the movable contact member to the closed position and establish electrical communication through the switch until the disc has returned to its original (or switch-closed) configuration. More specifically, in instances where the temperature does not go below the predetermined temperature, the movable contact member is prematurely returned to the switch-closed position which in some instances results in malfunction of the switch or other temperature-related hazard. Oftentimes it is desirable to open or close an electric circuit and retain it in such condition until the switch is manually reset and only after the temperature has returned to an acceptable level (i.e., below the predetermined temperature).

Several switches have been designed to address this problem. One such switch is disclosed in U.S. Pat. No. 4,039,991 to Bucheister, which is assigned to the assignee of the present application. This patent discloses a switch having a lock device that is engageable with a movable contact member in the switch-open position. The lock device comprises a spring lever which overlies the contact member and is secured to the housing by a rivet. A latch finger having an inclined surface defining a notch is attached to the spring lever. The notch is located so that the latch finger engages the contact member for retaining and maintaining the contact member in a switch-open position upon the bimetallic disc flexing in response to increased temperature.

It should be noted that the reset feature of Bucheister's switch, while sufficiently suitable from a performance standpoint, is relatively complex in design and expensive to manufacture. This is due to the additional component parts required to achieve the lock device, i.e., the spring lever, rivet, and latch finger, and the additional assembly time.

SUMMARY OF THE INVENTION

In general, the present invention is directed to a thermostatic switch comprising a housing having a cavity formed therein, and a temperature responsive bimetallic disc located in the housing and responsive to a predetermined temperature for exerting a flexing action. A fixed contact member is located in the cavity, and is electrically interconnected to a first terminal external to the housing. A movable contact member is also located in the cavity adjacent the fixed contact member. The movable contact member is electrically interconnected to a second terminal external to the housing, and is spring mounted and movable between a switch-closed position in which it makes electrical contact with the fixed contact member and a switch-open position in which it is spaced from the fixed contact member. The movable contact member has an arm portion with an opening formed therein, the purpose of which will be described below. An actuating member or pin is located in the housing, and is responsive to flexing movement of the disc for moving the movable contact member from the switch-closed position to the switch-open position. The switch further includes locking means for locking the second contact member in the switch-open position. The locking means comprises a hook portion mounted within the cavity of the housing, the hook portion engaging the arm portion of the movable contact member upon the movement of the movable contact member to its switch-open position and entering the opening of the arm portion for retaining and maintaining the movable contact member in its switch open position. The arrangement is such that the movable contact member is free to return to the normal switch-closed position by the spring action thereof when both the hook portion is released from the arm portion of the movable contact member and the pin is in the switch-closed position.

The switch further includes means for releasing the hook portion from the arm portion of the movable contact member thereby enabling the movable contact member to assume its switch-closed position. More specifically, the releasing means comprises an opening formed in the housing adjacent the interconnection of the hook portion and arm portion of the movable contact member when the movable contact member is in its switch-open position. The opening is sized to receive an implement therethrough for disengaging the hook portion from the arm portion. The releasing means may alternatively include an elongate reset element having a first end accessible from outside the housing and a second opposite end positioned adjacent the interconnection of the hook portion and arm portion of the movable contact member when the movable contact member is in its switch-open position. The arrangement is such that upon linearly moving the first end of the reset element towards the cavity of the housing, the second end of the reset element engages the hook portion for moving the hook portion away from the arm portion thereby disengaging the hook portion from the arm portion.

Accordingly, among the several objects of the present invention are the provision of a thermostatic switch having a manual reset built into the actuating mechanism of the switch thereby obviating the need to provide and assemble separate components for maintaining the switch in a switch-open position; the provision of such a switch which is comprised of relatively few components and is easy to assemble; the provision of such a switch which returns to a switch-closed position only after a bimetallic disc of the switch has flexed to the switch-closed position in response to the temperature returning to an acceptable level; the provision of such a switch which is sturdy in construction and durable in use; and the provision of such a switch which is cost-efficient to manufacture.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
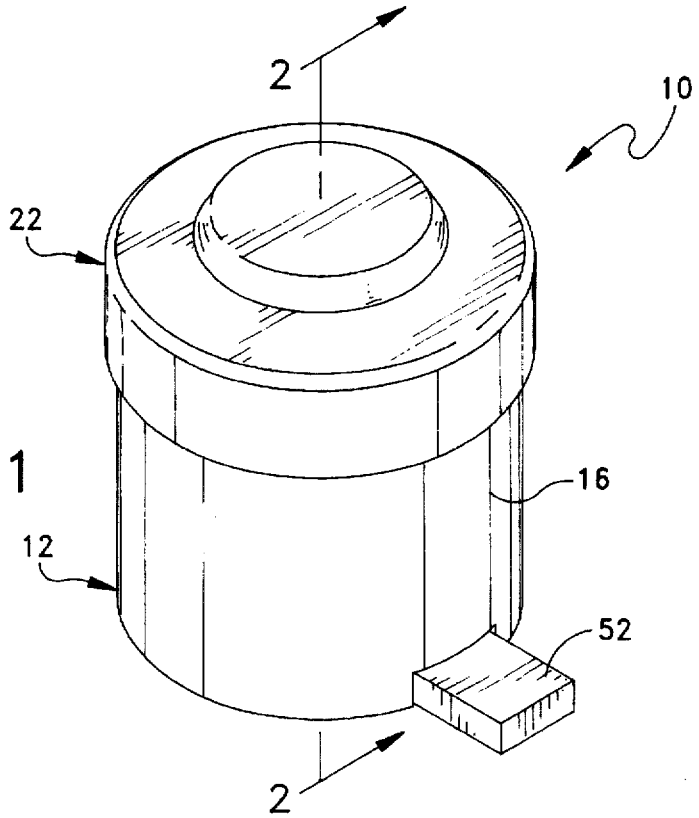
FIG. 1 is a perspective view of a thermostatic switch of the present invention.
Figure 5:
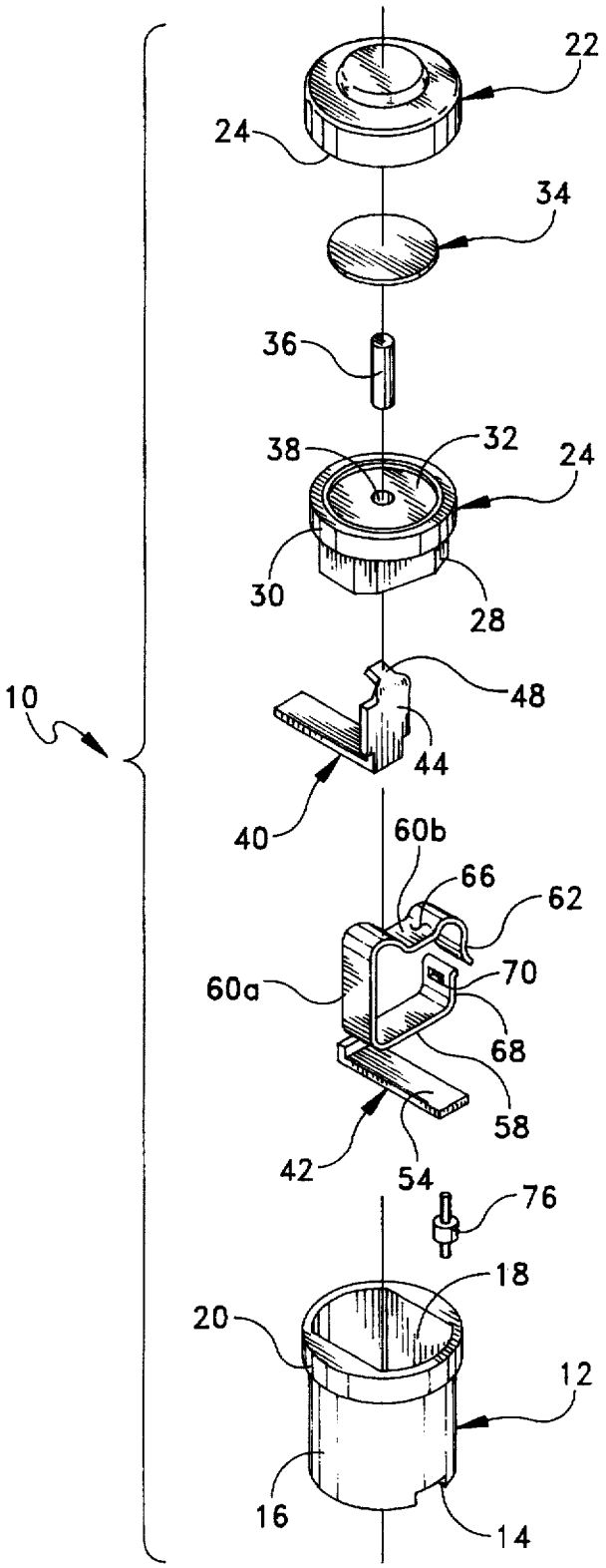
FIG. 5 is an exploded perspective view of the thermostatic switch illustrated in FIG. 1.

Referring to the drawings, and to FIGS. 1 and 5 in particular, there is generally indicated at 10 a thermostatic switch which is utilized in small electric appliances, such as cooking units, coffee percolators, photocopying machines, computers and the like. As shown, the switch 10 comprises a cylindrical housing, generally indicated at 12, having a base portion 14 and an annular wall 16 that is integrally formed with the base portion 14. The base portion 14 and annular wall 16 of the housing 12 define an internal cavity 18 which receives the operable components of the switch. The housing 12 is preferably fabricated from suitable insulating or dielectric material of the type conventionally used in switch manufacture, such as plastic or ceramic material.

Figure 2:
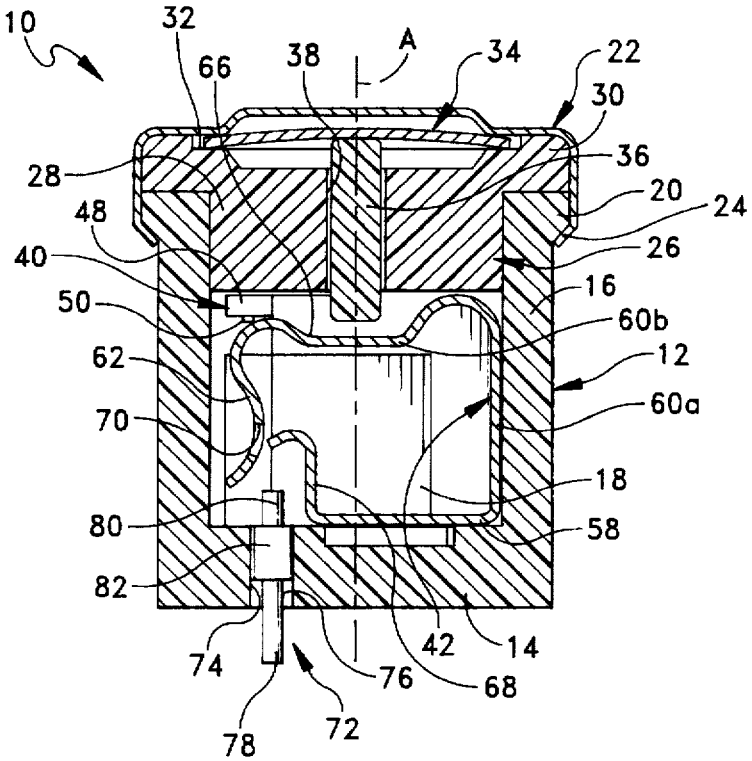
FIG. 2 is a cross-sectional view taken along line 2—2 of FIG. 1 illustrating the switch in a switch-closed position.
Figure 3:
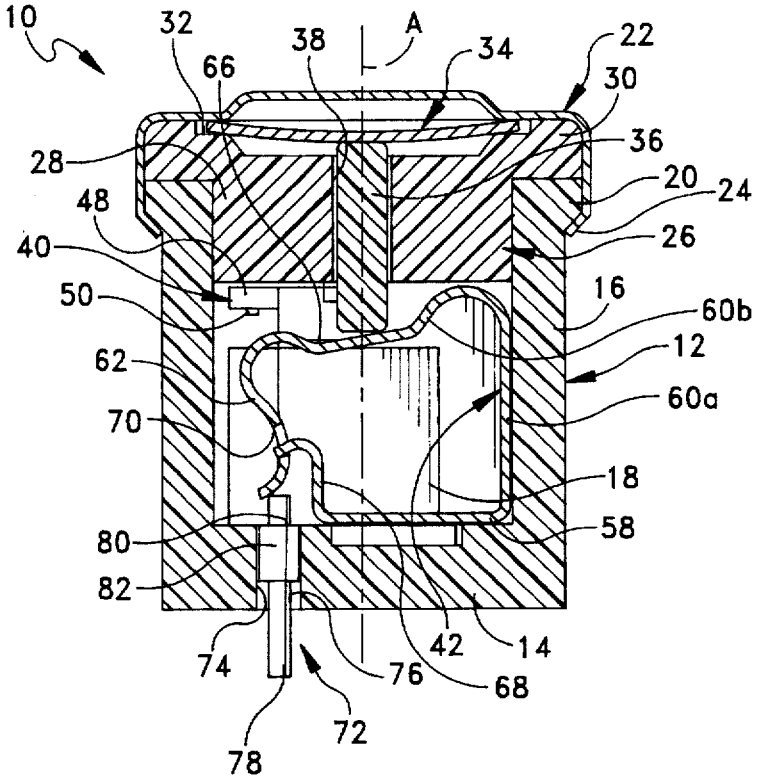
FIG. 3 is a view similar to FIG. 2 illustrating the switch in a switch-open position.
Figure 4:
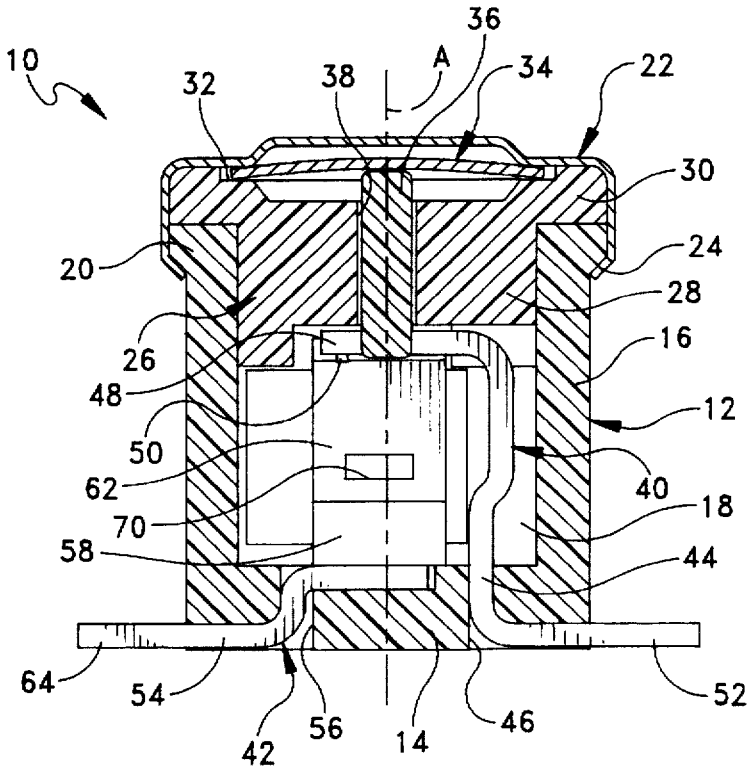
FIG. 4 is a cross-sectional view taken along a plane perpendicularly disposed to the plane of the cross section taken in FIG. 2.

Turning now to FIGS. 2–4, the upper edge margin 20 of the annular wall 16 of the housing 12 is flared outwardly so that an end cap, generally designated at 22, is crimped to the outwardly flared lower edge margin 20 of the wall 16 to close the open end of the housing 12 providing inwardly flared lips 24. The end cap 22 is preferably fabricated from any suitable thermally conductive material, such as aluminum or steel. The end cap 22 is provided for securing a pin guide, generally indicated at 26, therein and for maintaining the pin guide 26 and housing 12 in assembled relation. The pin guide 26 comprises a reduced diameter portion 28 which extends within the cavity 18 of the housing 12 and an increased diameter portion 30 which fits within the end cap 22.

As illustrated in FIGS. 2–4, the upwardly facing surface of the pin guide 26 has a recessed area 32 for receiving a temperature responsive bimetallic disc, generally indicated at 34, therein. The disc 34 is captured within the recessed area 32 by the cap 22, and is, under normal operating temperatures, flexed upwardly as illustrated in FIG. 2. Such discs are well-known in the art of thermostatic switches, and are adapted to flex in an opposite direction responsive to temperature changes of the environment in which they are placed. Thus, the disc 34 illustrated in FIG. 2 is adapted to flex downwardly when the temperature in the environment in which the switch is placed reaches a predetermined temperature. As shown, the disc 34 engages an actuating member or pin 36 located in an axial bore 38 formed in the pin guide along vertical axis A. The upper end of the pin 36 axially engages the disc 34 and is moved linearly downwardly upon the disc 34 flexing when the temperature reaches or exceeds the predetermined temperature.

Provided within the cavity 18 of the housing 12 are fixed and movable contact members, designated generally at 40, 42, respectively. The fixed and movable contact members 40, 42 are fabricated from any suitable conductive material which is capable of handling high electric loads. As best illustrated in FIGS. 4 and 5, the fixed contact member 40 has an L-shaped stem portion 44 which extends through a narrow slot 46 (see FIG. 4) formed in the base portion 14 of the housing 12, and a contact portion 48 which extends perpendicularly from the upper end of the stem portion 44. As shown in FIGS. 2–4, the contact portion 48 is positioned adjacent the reduced diameter portion 28 of the pin guide 26 and the annular wall 16 of the housing 12. The contact portion 48 includes a downwardly formed contact point 50, the purpose of which will be described in greater detail below. The stem portion 44 of the fixed contact member 40 which is located outside the housing 12 is bent so that it lies along a plane generally parallel to the plane of the base portion 14 of the housing 12. This bent section of the stem portion 44 constitutes a first terminal 52 which is external of the housing 12 (see FIG. 4).

The movable contact member 42 is located in the cavity 18 of the housing 12 adjacent the fixed contact member 40. As best shown in FIGS. 4 and 5, the movable contact member 42 includes a stem portion 54 which extends through another narrow slot 56 formed in the base portion 14 of the housing 12 and a substantially closed loop section generally indicated at 58 integrally formed (e.g., by welding or riveting) with the stem portion 54. The closed loop section 58 has an interconnecting portion having first and second leg portions **60*a* and 60*b*, and an arm portion 62 extending from the second leg portion 60*b* of the interconnecting portion. The second leg portion 60*b* is biased in an upward direction with respect to the L-shaped first leg portion 60*a*. As with the fixed contact member 40, the stem portion 54 of the movable contact member 42 is located outside the housing 12, and is bent so that it lies along a plane generally parallel to the plane of the base portion 14 of the housing 12 in a direction opposite to the first terminal 52. This bent section of the stem portion 54 of the movable contact member 42 constitutes a second terminal 64 which is external of the housing 12 (see FIG. 4). The first and second terminals 52, 64 are electrically connected to the apparatus, such as by welding, etc., in which the switch 10 is located in a manner well-known in the art. It should also be noted that the terminals 52, 64** can extend vertically instead of the shown horizontal extension.

The second leg portion **60*b* of the movable contact member 42 is biased and upwardly movable between a normally switch-closed position in which the second leg portion 60*b* of the interconnecting portion is in electrical contact with the contact point 50 of the contact portion 48 of the fixed contact member 40 (FIG. 2) and a switch-open position in which the second leg portion 60*b* of the interconnecting portion is spaced from the contact portion 48 of the fixed contact member 40 (FIG. 3). The arrangement is such that upon reaching a predetermined temperature, the disc 34 flexes downwardly thereby moving the pin 36 linearly downwardly. The lower end of the pin 36 then engages a contact surface 66 of the movable contact member 42 for moving the second leg portion 60*b* of the interconnecting portion of the contact member 42 away from the contact portion 48 of the fixed contact member 40. This movement opens the switch 10**.

It should be observed that the thermostatic switch 10 described to this point is substantially similar to other prior art switches. However, the switch 10 of the present invention comprises novel means for locking the arm portion 62 of the movable contact member 42 in the switch-open position. More particularly, the locking means comprises a hook portion 68 integrally formed with the first leg portion 60*a* of the closed loop section 58 of the movable contact member 42. As shown, the hook portion 68 extends upwardly so that it is adjacent the arm portion 62. The hook portion 68 is adapted to engage the arm portion 62 of the movable contact member 42 upon the downward movement of the arm portion 62 to its switch-open position. The arm portion 62 has a rectangular opening 70 formed therein which is sized to receive the end of the hook portion 68 therethrough when the arm 62 portion of the movable contact member 42 is moved downwardly and in a counterclockwise motion by the pin 36 to its switch-open position. In this position, the hook portion 68 interconnects with the arm portion 62 and maintains it in this position (i.e., the switch-open position) until the hook portion 68 is released from the arm portion 62. This configuration is illustrated in FIG. 3. The hook portion 68 and arm portion 62 are resilient and once disengaged, they assume their respective configurations illustrated in FIG. 2.

The thermostatic switch 10 of the present invention further includes means, generally indicated at 72, for releasing the hook portion 68 from the arm portion 62 of the movable contact member 42 to enable the movable contact member 42 to assume its switch-closed position. Means 72 comprises an opening 74 formed in the base portion 14 of the housing 12 adjacent the interconnection of the hook portion 68 and the arm portion 62 of the movable contact member 42 when it is in its switch-open position. In a preferred embodiment, a reset element 76 is disposed within the opening 74 for disengaging the hook portion 68 from the arm portion 62. The reset element 76 has a first (lower) end 78 which is accessible from outside the housing 12 and a second opposite (upper) end 80 which extends within the cavity 18 and is positioned adjacent the point of interconnection of the hook portion 68 and the arm portion 62 when the movable contact member 42 is in its switch-open position. The reset element 76 is suitably secured to the base portion of the housing at 82 and is biased in a lower position by a spring (not shown). The arrangement is such that upon linearly moving the first end 78 of the reset element 76 towards the cavity 18 of the housing 12, the second end 80 of the element 76 engages the arm portion 62 for moving the arm portion 62 away from the hook portion 68 for disengaging the hook portion 68 from the arm portion 62. This allows the movable contact member 42 to re-assume its switch-closed position. Alternatively, instead of the reset means illustrated in the drawings, an implement (not shown), such as a long thin member, which is sized for being slidably received through the opening 74, is received therethrough for disengaging the hook portion 68 from the arm portion 62.

Figure 6:
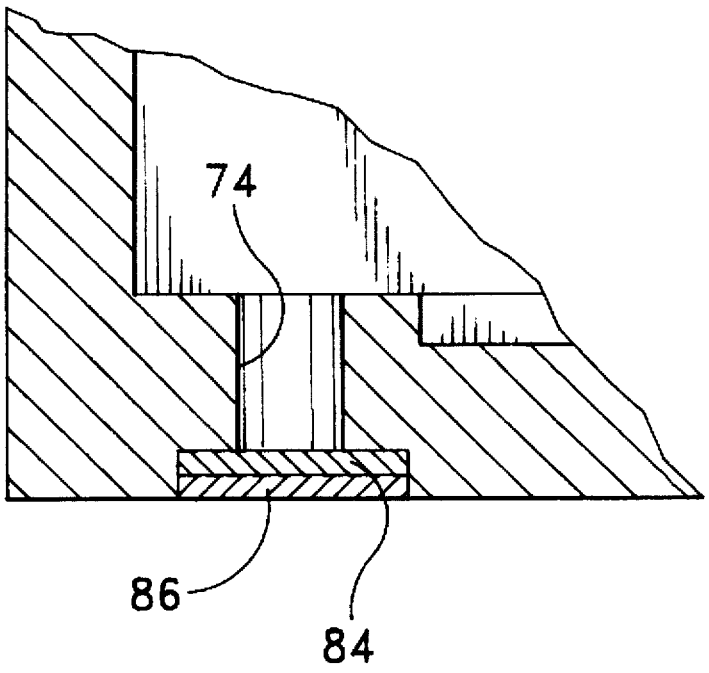
FIG. 6 is an enlarged detail view of another preferred embodiment of the invention.

FIG. 6 illustrates another preferred embodiment of the switch 10 which operates as a single operation device. As shown, the opening 74 is sealed by a thin wafer 84 which is held in place by a layer of epoxy material 84 which is poured into the cavity in a liquid state. The wafer 84 and layer of epoxy are preferably of dielectric materials. Any other method of sealing the opening can be used, such as with a pressed plug screw or the like, without departing from the scope of the present invention.

Turning now to FIG. 5, which illustrates the component parts of the thermostatic switch 10 in a pre-assembled configuration, the assembly of the switch 10 is as follows. The fixed contact and movable contact members 40, 42 are secured to the housing 12 by sliding them through their respective slots 46, 56, adding the component parts and crimping the cap 22. The contact members 40, 42 are assembled in such a manner that the second leg portion 60*b* of the closed loop section 58 of the movable contact member 42 is in engagement with the contact point 50 of the contact portion 48 of the fixed contact member 40. This position is illustrated in FIG. 2. Next, the pin guide 26 is inserted into the open end of the housing 12 to a point where the shoulder created at the junction of the reduced and increased diameter portions 28, 30 is in engagement with the open end of the annular wall 16 of the housing 12. The pin 36 is then inserted into the bore 38 of the pin guide 26. After the insertion of the pin 36 in the pin guide 26, the bimetallic disc 34 is inserted into the recessed area 32 of the pin guide 26 in such a position that its concave surface faces downwardly as illustrated in FIG. 2. The end cap 22 is next disposed over the open end of the housing 12 such that the inwardly flared lips 24 of the end cap 22 crimpingly engage the upper end margin 20 of the wall 16 of the housing 12 to close the open end of the housing 12. The end cap 22 secures the disc 34, pin guide 26, and pin 36 in assembled relation.

During operation of the thermostatic switch 10, under normal operational conditions where the temperature of the environment in which the switch 10 is placed is below a predetermined level, for example, the switch 10 assumes the switch-closed configuration illustrated in FIG. 2. It should be noted that the switch can be configured to be spring loaded in the switch-open position if desired. As shown, the fixed contact member 40 is in contact with the movable contact member 42 thereby providing electrical communication between the first and second terminals 52, 64 for completing the circuit. When the temperature in the environment reaches or exceeds the predetermined temperature, the bimetallic disc 34 flexes from the configuration of FIG. 2 to the configuration illustrated in FIG. 3. In this position, the concave surface of the disc 34 faces upwardly. The flexing action of the bimetallic disc 34 causes the pin 36 to move linearly downwardly. The lower end of the pin 36 engages the contact surface 66 of the second leg portion 60*b* of the interconnecting portion of the movable contact member 42 and forces the portion 60*b* away from the button 50 of the contact portion 48 of the fixed contact member 40. This motion of the movable contact member 42 away from the fixed contact member 40 opens the circuit and prohibits electrical communication between the first and second terminals 52, 64.

The movable contact member 42 is maintained in its switch-open position by the hook portion 68 which is integrally formed with the movable contact member 42. More specifically, as the second leg portion 60*b* of the interconnecting portion is moved away from the fixed contact member 40 by pin 36, the arm portion 62 moves downwardly and rotates counterclockwise so that it moves towards the hook portion 68. In this position, the hook portion 68 enters the opening 70 of the arm portion 62, and engages the arm portion, for maintaining the movable contact member 42 in its switch-open position. The only way the movable contact member 42 can return to its switch-closed position is by pressing the reset element 76 so that the hook portion 68 disengages from the arm portion 62 whereby the spring action of the second leg portion 60*b* of the interconnecting portion causes the arm portion 62 to move upwardly and clockwise away from the hook portion 68. Alternatively, any suitable implement can be used to disengage the hook portion 68. However, it should be noted that the reset element 76 will not function to reset the movable contact member 42 in its switch-closed position if the bimetallic disc 34 is still flexed downwardly. Only after the temperature returns to an acceptable temperature, can the reset element 76 function to return the movable contact member 42 in its switch-closed position in which it engages the fixed contact member 40.

It should be observed that the thermostatic switch 10 with reset of the present invention comprises a minimal number of component parts since the locking means is incorporated directly into the movable contact member 42. This decreases the cost of the switch's manufacture along with quickening the response time of the present switch over those of the prior art since there is a fewer number of component parts.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A thermostatic switch comprising:

a housing having a cavity formed therein;

a temperature responsive bimetallic disc located in said housing and being responsive to a predetermined temperature for exerting a flexing action;

a fixed contact member located in said cavity and being electrically interconnected to a first terminal external to said housing;

a movable contact member located in said cavity adjacent said fixed contact member, said movable contact member being electrically interconnected to a second terminal external to said housing, and being biased and movable between a switch-closed position in which it makes electrical contact with said fixed contact member and a switch-open position in which it is spaced from said fixed contact member, said movable contact member having an arm portion with an opening formed therein;

an actuating member located in said housing and being responsive to flexing movement of said disc for moving said movable contact member from said switch-closed position to said switch-open position; and locking means for automatically engaging and locking said movable contact member in the switch-open position, said locking means comprising a hook portion mounted within the cavity of the housing, said hook portion engaging said arm portion of the movable contact member upon the movement of the movable contact member to its switch-open position and entering said opening of the arm portion for retaining and maintaining the movable contact member in its switch open position, said hook portion being integrally formed as one-piece with said movable contact member, the arrangement being such that the movable contact member is free to return to the normal switch-closed position by the spring action thereof when both the hook portion is released from the arm portion of the movable contact member and said actuating member is in the switch-closed position.

2. A thermostatic switch as set forth in claim 1 further comprising means for releasing the hook portion from the arm portion of the movable contact member thereby enabling the movable contact member to assume its switch-closed position.

3. A thermostatic switch as set forth in claim 2, said releasing means comprising an opening formed in housing adjacent the interconnection of the hook portion and arm portion of the movable contact member when the movable contact member is in its switch-open position, said opening being sized to receive an implement therethrough for disengaging the hook portion from the arm portion.

4. A thermostatic switch as set forth in claim 2, said releasing means comprising a reset element having a first end accessible from outside the housing and a movable opposite end positioned adjacent the interconnection of the hook portion and arm portion of the movable contact member when the movable contact member is in its switch-open position, the arrangement being such that upon linearly moving the first end of the reset element towards the cavity of the housing, the second end of the reset element engages said arm portion for moving the arm portion away from the hook portion thereby disengaging the hook portion from the arm portion.

5. A thermostatic switch as set forth in claim 1, said actuating member comprising a pin located in said housing, said pin having one end which axially engages said bimetallic disc and an opposite end which axially engages said movable contact member, said flexing movement of the disc moving said pin in a longitudinal direction for urging said movable contact member out of engagement with the fixed contact member and into its switch-closed position.

6. A thermostatic switch comprising:

a housing having a cavity formed therein;

a temperature responsive bimetallic disc located in said housing and being responsive to a predetermined temperature for exerting a flexing action;

a fixed contact member located in said cavity and being electrically interconnected to a first terminal external to said housing;

a movable contact member located in said cavity adjacent said fixed contact member, said movable contact member being electrically interconnected to a second terminal external to said housing, and being biased and movable between a switch-closed position and a switch-open position, said movable contact member having an arm portion with an opening formed therein;

an actuating member located in said housing and being responsive to flexing movement of said disc for moving said movable contact member from said switch-closed position to said switch-open position; and locking means comprising a hook portion mounted within the cavity of the housing, said hook portion engaging said arm portion of the movable contact member upon the movement of the movable contact member to its switch-open position and entering said opening of the arm portion for retaining and maintaining the movable contact member in its switch open position, said hook portion being integrally formed as one-piece with said movable contact member.

7. A thermostatic switch comprising:

a housing having a cavity formed therein;

a temperature responsive bimetallic disc located in said housing and being responsive to a predetermined temperature for exerting a flexing action;

a fixed contact member located in said cavity and being electrically interconnected to a first terminal external to said housing;

a movable contact member located in said cavity adjacent said fixed contact member, said movable contact member being electrically interconnected to a second terminal external to said housing, and being biased and movable between a switch-closed position and a switch-open position, said movable contact member having an arm portion with an opening formed therein;

an actuating member located in said housing and being responsive to flexing movement of said disc for moving said movable contact member from said switch-closed position to said switch-open position; and a hook portion mounted within the cavity of the housing, said hook portion engaging said arm portion of the movable contact member upon the movement of the movable contact member to its switch-open position and entering said opening of the arm portion for retaining and maintaining the movable contact member in its switch open position, the arrangement being such that the movable contact member is free to return to the normal switch-closed position by the spring action thereof when both the hook portion is released from within the opening of the arm portion of the movable contact member and said actuating member is in the switch-closed position.

* * * * *